US007270172B1

(12) United States Patent
Aufderheide

(10) Patent No.: US 7,270,172 B1
(45) Date of Patent: Sep. 18, 2007

(54) PROCESS FOR CASTING A METAL

(75) Inventor: Ronald C. Aufderheide, Delaware, OH (US)

(73) Assignee: Ashland Licensing and Intellectual Property LLC, Dublin, OH (US)

( * ) Notice: Subject to any disclaimer, the term of this patent is extended or adjusted under 35 U.S.C. 154(b) by 0 days.

(21) Appl. No.: 11/266,014

(22) Filed: Nov. 3, 2005

Related U.S. Application Data

(60) Provisional application No. 60/625,250, filed on Nov. 5, 2004.

(51) Int. Cl.
*B22C 9/08* (2006.01)

(52) U.S. Cl. ..... 164/359; 249/197; 249/204

(58) Field of Classification Search ..... 164/359, 164/360; 249/197–204
See application file for complete search history.

(56) References Cited

U.S. PATENT DOCUMENTS 3,433,293 A * 3/1969 Ponzar ..... 164/358
4,141,406 A * 2/1979 Wukovich ..... 164/359
6,133,340 A * 10/2000 Menon ..... 523/139

FOREIGN PATENT DOCUMENTS

JP 56-71556 * 6/1981

* cited by examiner

*Primary Examiner*—Kuang Y. Lin
(74) *Attorney, Agent, or Firm*—David L. Hedden

(57) ABSTRACT

This invention relates to an improved process for casting a metal by pouring molten metal into and around a casting assembly, where a riser containing a sleeve is a component of the casting assembly. The process comprises (a) inserting a riser insert into the cavity of the riser containing the sleeve, and (b) then allowing molten metal to flow into the cavity of the riser containing the riser insert. The density of the riser insert is such that the riser insert floats on the surface of the molten metal when the molten metal enters the cavity of the riser and provides a thermal barrier to reduce heat loss from the riser. The sleeve is shaped such that the riser insert will not be forced out or float off of the riser cavity when the metal is poured.

9 Claims, 3 Drawing Sheets

PROCESS FOR CASTING A METAL

CLAIM TO PRIORITY

This application claims the benefit of U.S. Provisional Application No. 60/625,250 filed on Nov. 5, 2004, the contents of which are hereby incorporated into this application.

TECHNICAL FIELD

This invention relates to an improved process for casting a metal by pouring molten metal into and around a casting assembly, where a riser containing a sleeve is a component of the casting assembly. The process comprises (a) inserting a riser insert into the cavity of the riser containing the sleeve, and (b) then allowing molten metal to flow into the cavity of the riser containing the riser insert. The density of the riser insert is such that the riser insert floats on the surface of the molten metal when the molten metal enters the cavity of the riser and provides a thermal barrier to reduce heat loss from the riser. The sleeve is shaped such that the riser insert will not be forced out or float off of the riser cavity when the metal is poured.

BACKGROUND

A casting assembly typically consists of a pouring cup, a gating system (including downsprues, choke, and runner), risers, molds, cores, and other components. To produce a metal casting, metal is poured into the pouring cup of the casting assembly and passes through the gating system to the mold and/or core assembly where it cools and solidifies. The metal part is then removed by separating it from the core and/or mold assembly.

The molds and/or cores used in the casting assembly are typically made of sand and a binder, often by the no-bake or cold-box process. The sand is mixed with a chemical binder and typically cured in the presence of a liquid or vaporous catalyst after it is shaped.

Risers are cavities in which excess molten metal flows. The excess molten metal is needed to compensate for contractions or shrinkage of metal, which occur during the casting process. Metal from the riser fills such voids created in the casting when metal from the casting contracts. The metal from the riser must remain in a liquid state for a longer period of time, so it can provide molten metal to the casting as it cools and solidifies. Thus, it is advantageous to keep the molten metal in the riser hot as long as possible.

Heat loss from the riser occurs by convection to the cooler surroundings and through radiation to the cooler atmosphere. Because of this problem with heat loss associated with using open risers, closed risers that are surrounded by and covered with sleeve material, are sometimes used instead of open risers. One problem associated with the use of closed risers is that the operator cannot see when the riser cavity is full by visual inspections. In addition, closed risers do not provide venting of mold gasses to the atmosphere during pouring. These conditions can result in over-filling of the mold, metal spillage, and resulting safety hazards.

Because of the problems associated with using closed risers, open risers are sometimes preferred. When an open riser is used, the operator can visually inspect the riser cavity and determine when the level of molten metal in the riser cavity is appropriate. After the appropriate level is reached, in order to prevent heat loss from an open riser, the top of the riser cavity is covered with a hot-topping, e.g. a granular material, a powder, rice hulls, a blanket (see U.S. Pat. No. 3,876,420), and solid covers (graphite) having an insulating properties, exothermic properties, or both, within a relatively short period of time to prevent excessive heat loss. When an open riser is used, typically an extra person is needed to inspect the riser cavity and apply the topping following pouring.

If the hot-topping is a granular or powder material, it often spills across the top of the casting assembly onto the floor of the foundry. Because there is often spillage or misapplication, it is normal practice to apply much more than the optimum amount that is necessary. Additionally, when powdered materials are used, the powdered materials can miss the top of the riser and spill onto the casting assembly where it can eventually get mixed into the molding sand and consequently cause casting defects.

If blankets are placed on top of the riser, before the riser is filled with metal, the metal pourer is not able to see the metal fill the riser and the molten metal could overflow and spill onto the floor. If blankets are placed on the riser after the appropriate level of molten metal is reached, an extra person is usually required to inspect the riser cavity and to place the blanket on top of the open riser while the metal pourer moves on to pour the next mold. Furthermore, the metal in the riser is open to the atmosphere during the time between filling and when the blanket is applied, which results in heat loss. The longer the delay before the cover is placed over the cavity, the more heat is lost and the effectiveness of the riser is reduced.

WO 2004/000485 teaches that this problem can be solved if a riser insert, which is slightly smaller than the internal cross section of the riser, is inserted into the riser cavity before the metal is poured. Although the advantages of using the riser insert were realized in actual foundry applications, there was a problem that arose in using it in some applications. It was found that the riser inserts sometimes were not held in place by the riser and floated out of the riser cavity when the metal was poured, thus losing their effectiveness.

All citations referred to under this description of the "Related Art" and in the "Detailed Description of the Invention" are expressly incorporated by reference.

BRIEF SUMMARY

This invention relates to an improved process for casting a metal by pouring molten metal into and around a casting assembly, where a riser containing a sleeve is a component of the casting assembly. The process comprises (a) inserting a riser insert into the cavity of the riser containing the sleeve, and (b) then allowing molten metal to flow into the cavity of the riser containing the riser insert. The density of the riser insert is such that the riser insert floats on the surface of the molten metal when the molten metal enters the cavity of the riser and provides a thermal barrier to reduce heat loss from the riser. The sleeve is shaped such that the riser insert will not be forced out of the riser cavity when the metal is poured.

The process is an improvement over the process described in WO 2004/000485 because it utilizes a specially designed sleeve that incorporates a means to hold the floating cover lid in place on top of the metal in the open riser while at the same time allowing any excess metal that flows out of the top of the riser to do so without carrying the floating cover lid with it. Preferably, the sleeve holds the riser insert in place and keeps it positioned directly over the metal in the open riser.

The sleeve can be made from any number of materials and can be incorporated into the mold assemble in a wide variety of means. Any design that serves the required function is appropriate. A preferred design is shown in FIG. 1, which is a crowned sleeve design.

DETAILED DESCRIPTION

Figure 1:
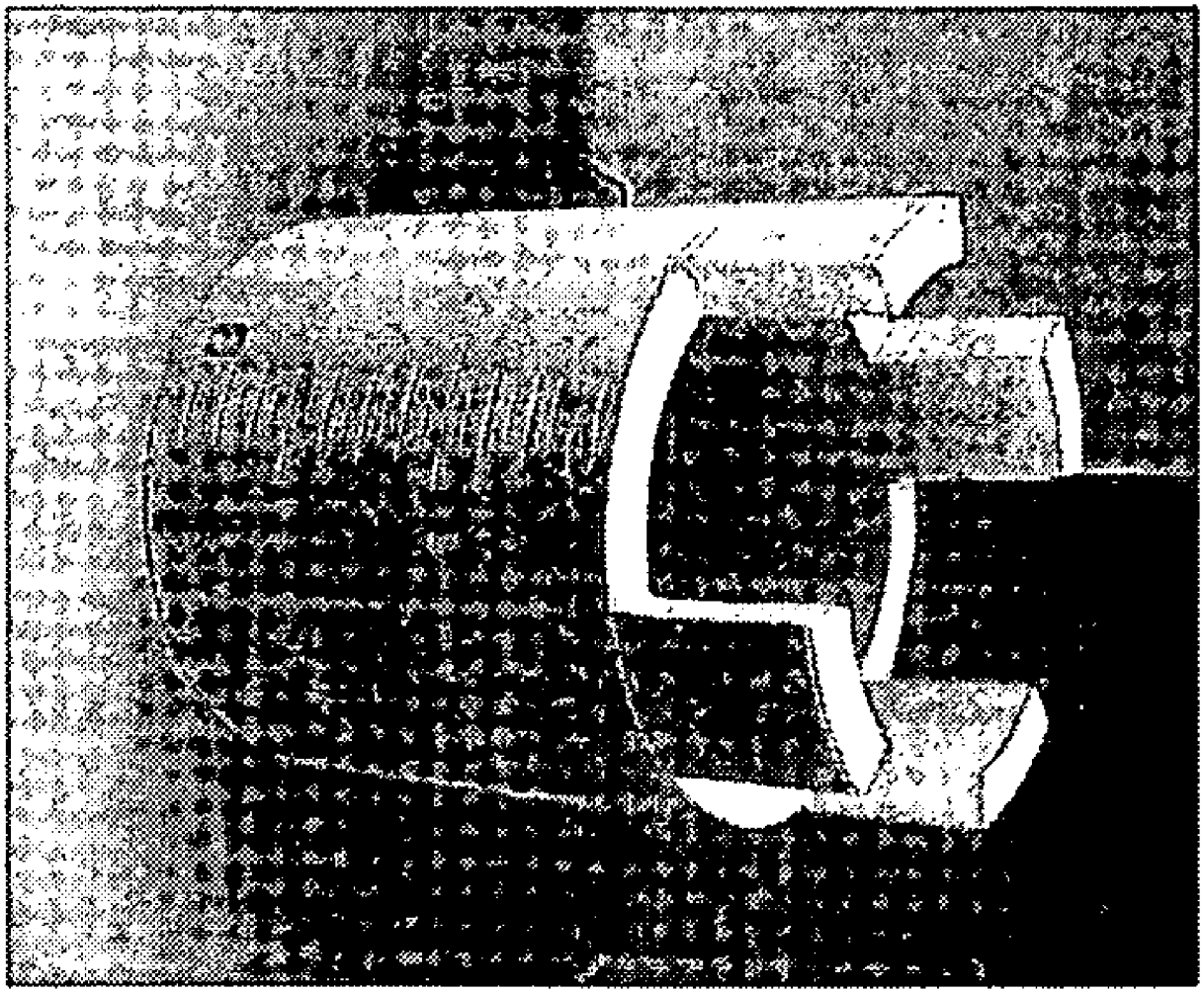
FIG. 1 Is a copy of a photograph of a crown-shaped sleeve.

The detailed description and examples will illustrate specific embodiments of the invention and will enable one skilled in the art to practice the invention, including the best mode. It is contemplated that many equivalent embodiments of the invention will be operable besides these specifically disclosed.

The riser sleeve can be made from any number of materials, including fiber-based insulating and/or exothermic materials, microspheres having exothermic and/or insulating properties, sand, mixtures thereof, etc.

The riser sleeve can be incorporated into the mold assemble in a wide variety of means For example, it can be incorporated as part of the mold itself, or it can be made separately and inserted into the riser cavity.

The riser insert is placed in the riser sleeve. For purposes of describing this invention, a "riser insert" is a shape, typically a circular disk, which fits into a riser cavity and will float on top of the molten metal when it enters the riser cavity. The riser is shaped so that the riser insert will not fall through the riser into other parts of the casting assembly, or the riser contains a barrier that prevents the riser insert from falling through the riser cavity to other parts of the casting assembly.

When the metal is poured and fills the riser, the riser insert floats on top of the molten metal. To float, the riser insert must be made of a material that has a density lower than that of the metal being poured. The riser insert can be made from a variety of materials, e.g. ceramic fiber-based refractories, granular refractories, sand, microspheres refractories, paper, cardboard, etc.

The riser insert is preferably used with an open riser (one that has a top that is open to the atmosphere), preferably an open riser that has a breaker core on the bottom or is a neckdown type riser where the bottom of the riser where it contacts the casting is smaller than the upper section of the riser. These types of risers will naturally keep the riser insert from falling down into the casting cavity.

In practice the riser insert is typically placed in the riser cavity when the mold is assembled. This eliminates the need for a person at the pouring area to place toppings or blankets on the molds after they are poured.

Preferably used to make the riser inserts and sleeves are low-density microspheres. See WO 2004/000485 for a description of a preferred method of how to make the riser insert and U.S. Pat. No. 6,133,340 for a description of a preferred method of how to make the riser sleeve, both which are hereby incorporated by reference.

Riser inserts and sleeves made with low-density microspheres are dimensional accurate and maintain their dimensional accuracy when the molten metal is poured into and around the casting assembly. This is important because the dimensionally accurate riser inserts do not stick in the riser cavity, and, consequently, are free floating. Riser inserts and sleeves made from these materials have thermal conductivities about ¼ the thermal conductivities of corresponding riser inserts and sleeves made from sand and they provide better insulating characteristics. Furthermore, the riser inserts are light-weight and have a low-density, they are easy to handle and provide the maximum buoyant force to insure that the riser insert floats to the top of the riser cavity when the molten metal is poured.

Examples of microspheres include hollow aluminosilicate microspheres, including aluminosilicate zeospheres. The riser inserts made with aluminosilicate hollow microspheres have low densities, low thermal conductivities, and excellent insulating properties. The thermal conductivity of the hollow aluminosilicate microspheres ranges from about 0.1 W/m·K to about 0.6 W/m·K at room temperature, more typically from about 0.15 W/m·K to about 0.4 W/m·K.

The hollow aluminosilicate microspheres used to make the riser inserts typically have a particle size of about 10 to 350 microns with varying wall thickness. Preferred are hollow aluminosilicate microspheres having an average diameter greater than 150 microns and a wall thickness of approximately 10% of the particle's diameter. It is believed that hollow microspheres made of material other than aluminosilicate, having insulating properties, can also be used to replace or used in combination with the hollow aluminosilicate microspheres.

The weight percent of alumina to silica (as $SiO_2$) in the hollow aluminosilicate microspheres can vary over wide ranges depending on the application, for instance from 25:75 to 75:25, typically 33:67 to 50:50, where said weight percent is based upon the total weight of the hollow microspheres. It is known that hollow aluminosilicate microspheres having a higher alumina content are better for making larger riser inserts used in pouring metals such as iron and steel which have casting temperatures of 1300° C. to 1700° C., because hollow aluminosilicate microspheres having more alumina have higher melting points. Thus riser inserts made with these hollow aluminosilicate microspheres will not degrade as easily at higher temperatures.

The density of the riser insert and/or sleeve typically ranges from about 0.3 g/cc to about 1.6 g/cc, more typically from about 0.4 g/cc to about 0.6 g/cc.

In some cases, it is desirable to have a riser insert and/or sleeve having exothermic 31 properties, in order to supply additional heat to the molten metal in the riser cavity. Riser inserts and sleeves are rendered exothermic by the addition of an oxidizable metal 33 and an oxidizing agent to the formulation used to make the riser insert. The oxidizing agent is capable of generating an exothermic reaction when it comes into contact with the molten metal poured. The oxidizable metal typically is aluminum, although magnesium and similar metals can also be used.

When aluminum metal is used as the oxidizable metal for the exothermic riser insert, it is typically used in the form of aluminum powder and/or aluminum granules. The oxidizing agents used for the exothermic riser insert includes iron oxide, manganese oxide, etc. Oxides do not need to be present at stoichiometric levels to satisfy the metal aluminum fuel component since the riser inserts, sleeves, and molds in which they are contained are permeable. Thus oxygen from the oxidizing agents is supplemented by atmospheric oxygen when the aluminum fuel is burned. Typically the weight ratio of aluminum to oxidizing agent is from about 10:1 to about 2:1, preferably about 5:1 to about 2.5:1.

The thermal properties of the exothermic riser insert and/or sleeve are enhanced by the heat generated, which reduces the temperature loss of the molten metal in the riser, thereby keeping it hotter and liquid longer. The typical exotherm in sleeves and sleeve related products results from the oxidizing reaction of aluminum metal. A mold and/or core typically does not exhibit exothermic properties.

In addition, the riser insert and/or sleeve formulation may contain different fillers and additives, such as cryolite ($Na_3AlF_6$), potassium aluminum tetrafluoride, potassium aluminum hexafluoride, nitrates, paper, wood flour, sand, etc.

The binders that are used to hold the riser insert and sleeve composition together may include any inorganic or organic foundry binder and are well known in the foundry art. Any no-bake, cold-box binder, oil sand, or shell resin, which will sufficiently hold the riser insert composition together in the shape of a riser insert and/or sleeve and polymerize in the presence of a curing catalyst, will work. Examples of such binders are sodium silicate, phenolic resins, phenolic urethane binders, furan binders, alkaline phenolic resole binders, acid curable shell resins based upon phenolic novolac resins, and epoxy-acrylic binders among others. Particularly preferred are epoxy-acrylic binders (e.g. ISOSET® binders sold by Ashland Specialty Chemical, a division of Ashland Inc.), epoxy-acrylic-isocyanate binders e.g. ISOMAX® binders sold by Ashland Specialty Chemical, a division of Ashland Inc.), and phenolic urethane binders (e.g. EXACTCAST® and ISOCURE® binders sold by Ashland Specialty Chemical, a division of Ashland Inc.) cold-box binders. The phenolic urethane binders are described in U.S. Pat. Nos. 3,485,497 and 3,409,579, which are hereby incorporated into this disclosure by reference. These binders are based on a two part system, one part being a phenolic resin component and the other part being a polyisocyanate component. The epoxy-acrylic binders, cured with sulfur dioxide in the presence of an oxidizing agent, are described in U.S. Pat. No. 4,526,219, which is hereby incorporated into this disclosure by reference. The epoxy-acrylic-isocyanate binders, cured with a volatile amine, are described in U.S. Pat. No. 5,688,837, which is hereby incorporated into this disclosure by reference.

The amount of binder needed is an effective amount to maintain the shape of the riser insert and allow for effective curing, i.e. which will produce a riser insert which can be handled or self-supported after curing. An effective amount of binder will vary greatly depending upon the materials used to make the insert and can range from 0.8% to 14% based on the weight of the insert composition. Preferably the amount of binder ranges from about 1 weight percent to about 12 weight percent.

Curing the riser insert and/or sleeve by the no-bake process takes place by mixing a liquid curing catalyst with the riser insert mix (alternatively by mixing the liquid curing catalyst with the riser insert composition first), shaping the riser insert mix containing the catalyst, and allowing the riser insert shape to cure, typically at ambient temperature without the addition of heat.

The preferred liquid curing catalyst is a tertiary amine and the preferred no-bake curing process is described in U.S. Pat. No. 3,485,797, which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Curing the riser insert and/or sleeve by the cold-box process takes place by blowing or ramming the riser insert mix into a pattern and contacting the riser insert with a vaporous or gaseous catalyst. Various vapor or vapor/gas mixtures or gases such as tertiary amines, carbon dioxide, methyl format, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resins. See U.S. Pat. No. 4,526,219, which is hereby incorporated, into this disclosure by reference. Carbon dioxide (see U.S. Pat. No. 4,985,489, which is hereby incorporated into this disclosure by, reference) or methyl esters (see U.S. Pat. No. 4,750,716 which is hereby incorporated into this disclosure by reference) are used with alkaline phenolic resole resins. Carbon dioxide is also used with binders based on silicates. See U.S. Pat. No. 4,391,642, which is hereby incorporated, into this disclosure by reference.

Preferably the binder is an ISOCURE® cold-box phenolic urethane binder cured by passing a tertiary amine gas, such as triethylamine, through the molded riser insert mix in the manner as described in U.S. Pat. No. 3,409,579, or the epoxy-acrylic binder cured with sulfur dioxide in the presence of an oxidizing agent as described in U.S. Pat. No. 4,526,219. Typical gassing times are from 0.5 to 3.0 seconds, preferably from 0.5 to 2.0 seconds. Purge times are from 1.0 to 60 seconds, preferably from 1.0 to 10 seconds.

Abbreviations and definitions:

| | |
|---|---|
| Casting assembly | assembly of casting components such as pouring cup, downsprue, gating system (downsprue, runner, choke), molds, cores, risers, riser inserts, etc. which are used to make a metal casting by pouring molten metal into the casting assembly where it flows to the mold assembly and cools to form a metal part. |
| Cold-box | mold or core making process which utilizes a vaporous catalyst to cure the mold or core. |
| Downsprue | main vertical feed channel of the casting assembly through which the molten metal is poured. |

EXACTCAST® 101/202

| | |
|---|---|
| cold-box binder | a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component comprising a polymethylene polyphenyl isocyanate, a solvent blend consisting primarily of aromatic solvents and a minor amount of aliphatic solvents, and a benchlife extender. The weight ratio of Part I to Part II is about 55:45. |
| SGT | hollow aluminosilicate microspheres sold by PQ Corporation under the EXTENDOSPHERES ® trademark having a particle size of 10-350 microns |

-continued

| | |
|---|---|
| | and an alumina content between 28% to 33% by weight based upon the weight of the microspheres. |
| SLG | hollow aluminosilicate microspheres sold by Envirosperes Pty Ltd under the ENVIROSPHERES ® trademark having a particle size of 10-300 microns and an alumina content of at least 40% by weight based upon the weight of the microspheres. |
| Gating system | system through which metal is transported from the pouring cup to the mold and/or core assembly. Components of the gating system include the downsprue, runners, in-gates, choke, etc. |
| Mold assembly | an assembly of molds and/or cores made from a foundry aggregate (typically sand) and a foundry binder, which is placed in and/or around a casting assembly to provide a shape for the casting. |
| No-bake | mold or core making process which utilizes a liquid catalyst to cure the mold or core, also known as cold-curing. |
| Pouring cup | cavity into which molten metal is poured in order to fill the casting assembly. |
| Riser | cavity in the mold connected to the casting cavity of the casting assembly which acts as a reservoir for excess molten metal to prevent cavities in the casting as it contracts on solidification. Risers may be open or closed to the atmosphere. |
| Sleeve | any moldable shape having exothermic and/or insulating properties used to surround or encapsulate the riser and other parts of the casting assembly in order to keep the molten metal in the riser hot and maintain it in the liquid state. |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated.

Example 1

Preparation of Crown-Shaped Sleeves by Cold-Box Process and Cutting

A 5" by 12" sleeve was made along the lines of the process described in the Example 2 of U.S. Pat. No. 6,133,340. The amount of binder used was 10 weight percent. The sleeve was customized to form a crown-shaped sleeve by cutting windows in the top of the sleeve with a saw blade, so the inside walls and the windows of the sleeve would be in line and there would be no ledges that could catch the riser insert as it floated on the molten metal as it rises in the casting assembly. To do this, the sleeves were cut to an 8" length and then 2" openings were cut in the top of the sleeve. FIG. 1 shows how the custom made sleeves looked.

The purpose of the design was to have openings on the top sides of a riser sleeve that allow any excess metal that is poured into the riser to flow out while the sleeve extensions (crown shape) hold the floating cover lid in place.

Examples 2

Preparation of Disk-Shaped Riser Insert

Figure 2:
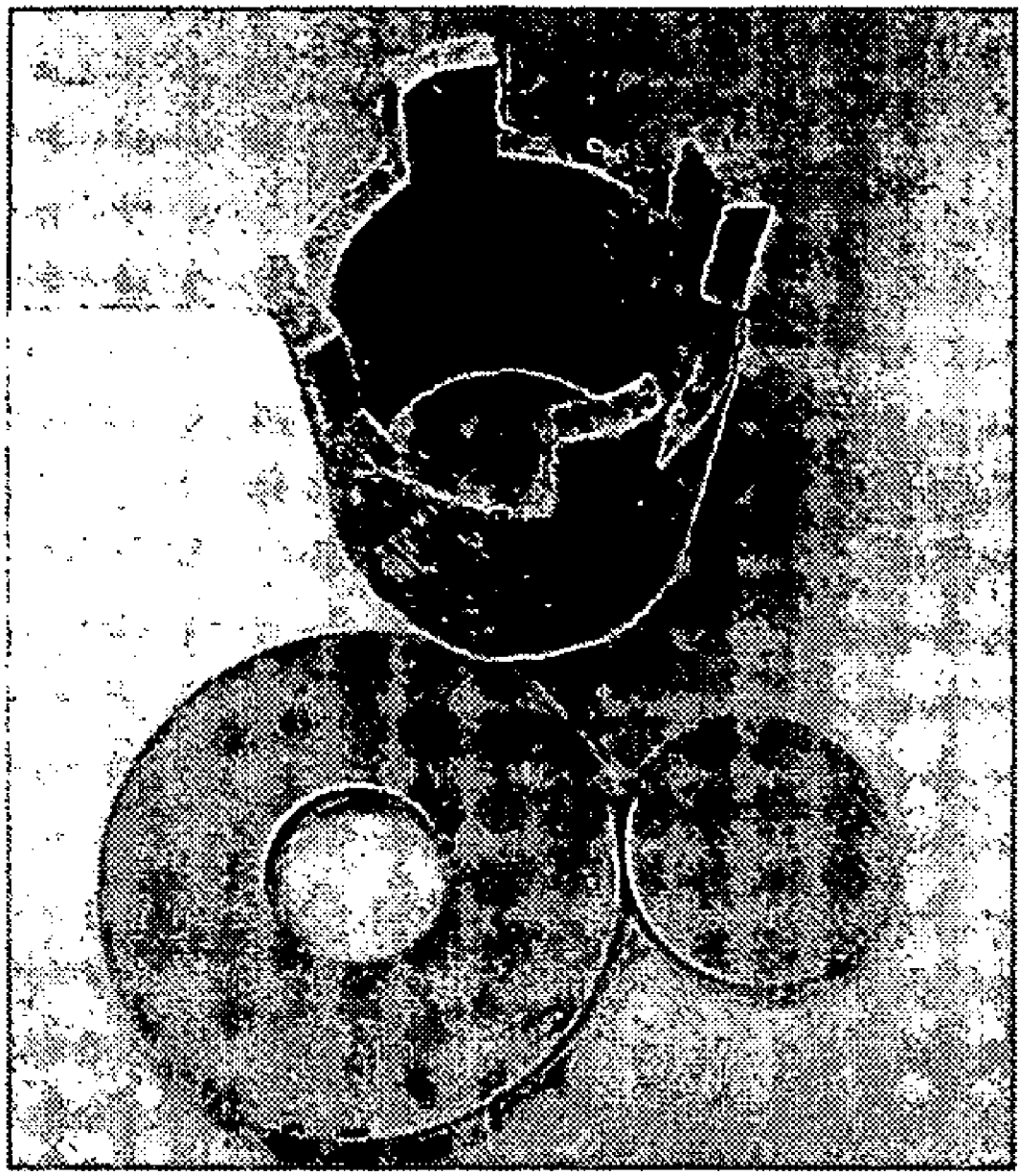
FIG. 2 Is a copy of a photograph showing the crown-shaped sleeve along with the riser insert (also described as a floating cover lid) which goes inside the crown-shaped sleeve and a breaker core which is affixed to the bottom of the crown-shaped sleeve.

An insulating disk-shaped riser insert was prepared. See FIG. 2. The formulation for the insulating disk-shaped riser insert consisted of a blend of SGT and SLG microspheres, 6% boric acid, and 9% EXACTCAST® 101/201 cold-box binder sold by Ashland Specialty Chemical Company, a division of Ashland Inc. The disk-shaped riser insert was prepared by blowing the formulation into a customized breaker core pattern with the inserts removed to create disks that were solid and approximately 3¼" in diameter by ⅜" thick. The pattern was then gassed with triethylamine in nitrogen at 20 psi according to known methods described in U.S. Pat. No. 3,409,579. Gas time is 0.5 seconds second, followed by purging with air at 20 psi for about 15 seconds.

Example 3

Figure 3:
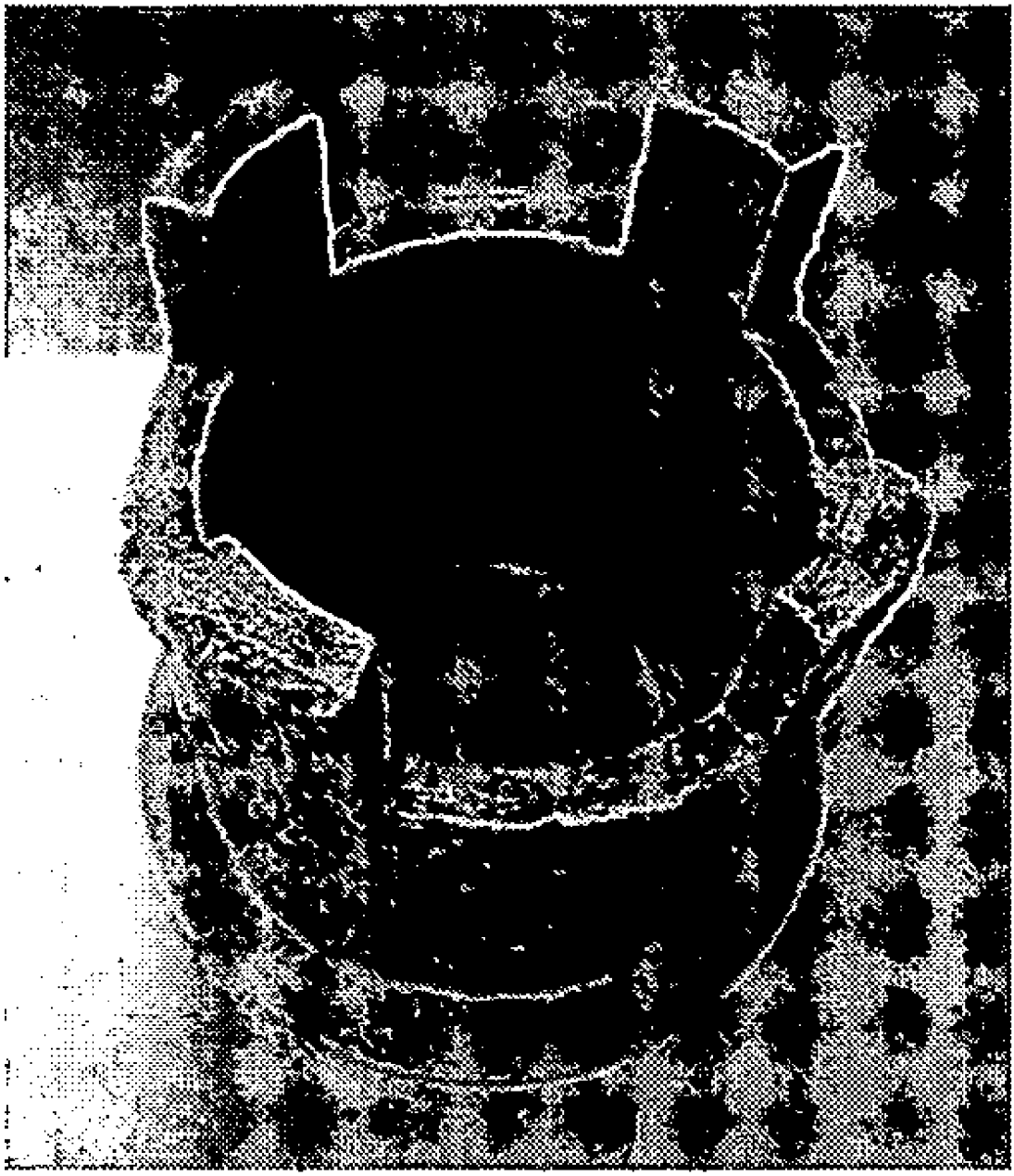
FIG. 3 Is a copy of a photograph showing the crown-shaped sleeve, riser insert, and the breaker core assembled as it would be used in the mold.

Use of the Crown Sleeve of Example 1 and Riser Insert of Example 2 in a Riser The disk-shape riser insert of Example 2 was dropped into a five-inch open riser containing the crown-shaped sleeve of Example 1. See FIG. 3. Molten gray iron, having a temperature of approximately 1480° C. was poured into and around the test casting assembly and filled the riser cavity.

The disk-shaped riser inserts floated in the riser cavity as the riser cavity filled, so that at the end of the pouring, the disk-shaped insert was on the top of the liquid metal at the cope surface of the mold. The riser insert stayed in place because the crown portion of the sleeve held the riser insert over the metal in the riser even though the metal overflowed from the riser. The castings were sound with no shrinkage defects.

I claim:

1. A process, for forming a metal casting by pouring molten metal into and around a casting assembly comprising an open riser having a cavity containing a sleeve, wherein said process comprises:

(a) inserting a riser insert into the cavity of the riser containing the sleeve, and (b) then allowing molten metal to flow into the cavity of the riser containing the riser insert, wherein the riser is shaped such that, or contains a barrier such that, the riser insert does not fall into other parts of the casting assembly before the molten metal is poured, the density of the riser insert is such that the riser insert floats on the surface of the molten metal when the molten metal enters the cavity of the riser, and the sleeve is shaped such that the sleeve holds the floating cover lid in place on top of the metal in the open riser after the molten metal is poured while excess metal is allowed to flow out of the top of the riser.

2. The process of claim 1 where the riser insert and/or sleeve act as barriers to heat loss from the metal in the riser by radiation and/or convection to the atmosphere.

3. The process of claim 2 wherein the riser insert and/or sleeve have insulating properties, exothermic properties, or both.

4. The process of claim 3 wherein the riser is a component of a casting assembly.

5. The process of claim 4 wherein the material used to make the riser insert and/or sleeve comprises hollow aluminosilicate microspheres.

6. The process of claim 5 where the riser contains a physical barrier to keep the riser insert in the riser and prevent the riser insert from falling out.

7. The process of claim 6 wherein the riser insert and/or sleeve are made by a cold-box process.

8. The process of claim 7 wherein the binder used in the cold-box process is a phenolic urethane binder and the catalyst is a vaporous tertiary amine catalyst.

9. The process of claim 8 wherein the riser contains a breaker core or is a neckdown riser.

* * * * *